US009637253B2

(12) United States Patent
Lasnier et al.

(10) Patent No.: US 9,637,253 B2
(45) Date of Patent: May 2, 2017

(54) REFILLABLE BOTTLE FOR DISPENSING A FLUID PRODUCT

(71) Applicant: Albea Le Treport, Le Treport (FR)

(72) Inventors: Jacky Lasnier, Sainte Marquerite sur Duclair (FR); Thomas Roosel, Notre Dame d'Aliermont (FR)

(73) Assignee: Albea Le Treport, Le Treport (FR)

( * ) Notice: Subject to any disclaimer, the term of this patent is extended or adjusted under 35 U.S.C. 154(b) by 52 days.

(21) Appl. No.: 14/843,029

(22) Filed: Sep. 2, 2015

(65) Prior Publication Data

US 2016/0090198 A1 Mar. 31, 2016

(30) Foreign Application Priority Data

Sep. 30, 2014 (FR) ..... 14 59299

(51) Int. Cl.
*B65B 3/04* (2006.01)
*B65D 47/24* (2006.01)
*B05B 11/00* (2006.01)

(52) U.S. Cl.
CPC ..... *B65B 3/04* (2013.01); *B05B 11/0056* (2013.01); *B65D 47/248* (2013.01)

(58) Field of Classification Search
CPC ..... B65D 1/06; B65D 47/248; B05B 11/0056; B65B 3/04
USPC ..... 141/113, 319, 363–366; 215/2
See application file for complete search history.

(56) References Cited

U.S. PATENT DOCUMENTS 8,152,025 B2 * 4/2012 Foster ..... B05B 11/0056 206/219
9,409,761 B2 * 8/2016 Lasnier ..... B05B 11/0056
9,499,388 B2 * 11/2016 Lasnier ..... B05B 11/0056

FOREIGN PATENT DOCUMENTS

EP 2708286 A1 3/2014
EP 2719466 A1 4/2014

OTHER PUBLICATIONS

French Application 1459299, International Search Report, dated May 28, 2015.

* cited by examiner

*Primary Examiner* — Timothy L Maust
(74) *Attorney, Agent, or Firm* — Banner & Witcoff, Ltd.

(57) ABSTRACT

A refillable bottle for dispensing a fluid product, comprising a container formed in a body. The bottle comprises a device for dispensing the packaged product mounted on the body in a sealed manner, and equipped with a valve for filling the container to allow a product source to be brought into communication with the container to fill the container. The valve comprises a conduit for communication between the source and the container, the conduit having a seat equipped with a flap valve movable relative to the seat between a sealed closed position and an open position of the conduit when the bottle is in an upside-down position. The flap valve has a device for resiliently stressing the seal in the closed position. The device can be uncoupled from the flap valve in order to release the subsequent movement of the flap valve between the closed and open positions thereof.

16 Claims, 5 Drawing Sheets

REFILLABLE BOTTLE FOR DISPENSING A FLUID PRODUCT

CROSS REFERENCE TO RELATED APPLICATION

This application claims priority to French Application Serial No. 1459299, filed Sep. 30, 2014, which is hereby incorporated by reference in its entirety.

FIELD

The invention relates to a refillable bottle for dispensing a fluid product, and to an assembly comprising such a bottle and a product source which is intended for filling said bottle.

In particular, the refillable bottle makes it possible to dispense a liquid product, for example a cosmetic treatment product, a make-up or perfume product, or a pharmaceutical product.

The refillable bottle comprises a body in which a container for packaging the product is formed, and a device for dispensing the packaged product which is mounted on said body in a sealed manner. In particular, the dispensing device may comprise removal means in the form of a manually operated pump which is supplied with packaged product, said pump being arranged to dispense the pressurised product, for example in the form of an aerosol. In a variant, the dispensing device may comprise means for applying the product, for example in the form of a ball.

In an application example, the refillable bottles according to the invention make it possible to dispense product samples, in particular for a volume of product packaged in the container which is between 1 and 10 ml. In particular, the samples thus distributed may allow a customer to test the product, the bottles thus being considered to be sample tester bottles. In a variant, the bottles can be referred to as "travel size" in that they make it easy to transport a smaller volume of product, compared with bottles having a greater capacity, which are generally heavy and large since they are luxury.

In these applications, for example for logistical reasons, reasons of convenience, or for environmental, recycling reasons, it may be desirable for it to be possible to refill the container with product from a source of said product. Indeed, it is impractical for a user to fill the container using a small funnel and it is not ecologically friendly to throw away an empty bottle and to replace it with a full one constituting a refill.

BACKGROUND

Refillable bottles are already on the market, in which the body is equipped with a valve for filling the container which is arranged to allow a product source to be brought into communication with said container in order to fill said container.

EP-2 708 286 describes such a refillable bottle, in which the valve comprises a conduit for communication between the source and the container, said conduit having a seat which is equipped with a flap valve which is movable relative to said seat between a sealed closed position and an open position of said conduit under the effect of gravity, which is caused by positioning the bottle in an upright position and in an upside-down position respectively.

This solution is not entirely satisfactory in that the flap valve is free to move between the closed and open positions thereof when the bottle is moved alternately between the upright and upside-down positions thereof, even when the valve is not connected to a product source, and this may adversely affect the sealing of said valve when said bottle is in use.

In over to overcome this drawback, EP-2 719 466 provides a device for locking the flap valve in the closed position, said device being arranged so as to be manually deactivated by the user. However, prior to filling the bottle, the user thus has to make a specific gesture in order to deactivate the device for locking the flap valve.

SUMMARY

The invention aims to improve upon the prior art by proposing in particular a bottle for which the filling gesture is simplified, while improving the sealing thereof, in particular between two bottle-filling operations.

For this purpose, according to a first aspect, the invention proposes a refillable bottle for dispensing a fluid product, comprising a body in which a container which is intended for packaging said product is formed, said bottle comprising a device for dispensing said packaged product which is mounted on said body in a sealed manner, said bottle being equipped with a valve for filling the container which is arranged to allow a product source to be brought into communication with said container in order to fill said container, said valve comprising a conduit for communication between said source and said container, said conduit having a seat which is equipped with a flap valve which is movable relative to said seat between a sealed closed position and an open position of said conduit when the bottle is in an upside-down position, the flap valve being equipped with a device for resiliently stressing the seal in the closed position, said device being arranged such that it can be uncoupled from the flap valve in order to release the subsequent movement of said flap valve between the closed and open positions thereof.

According to a second aspect, the invention proposes an assembly comprising such a refillable bottle and a product source which is intended to fill said refillable bottle, said source comprising a product container which is equipped with a mount which is arranged to allow the filling valve to be connected to the source container in a sealed manner while bringing the conduit into communication with said container.

BRIEF DESCRIPTION OF THE DRAWINGS

Other objects and advantages of the invention will become apparent in the following description, given with reference to the accompanying drawings, in which.

DETAILED DESCRIPTION

Figure 1A:
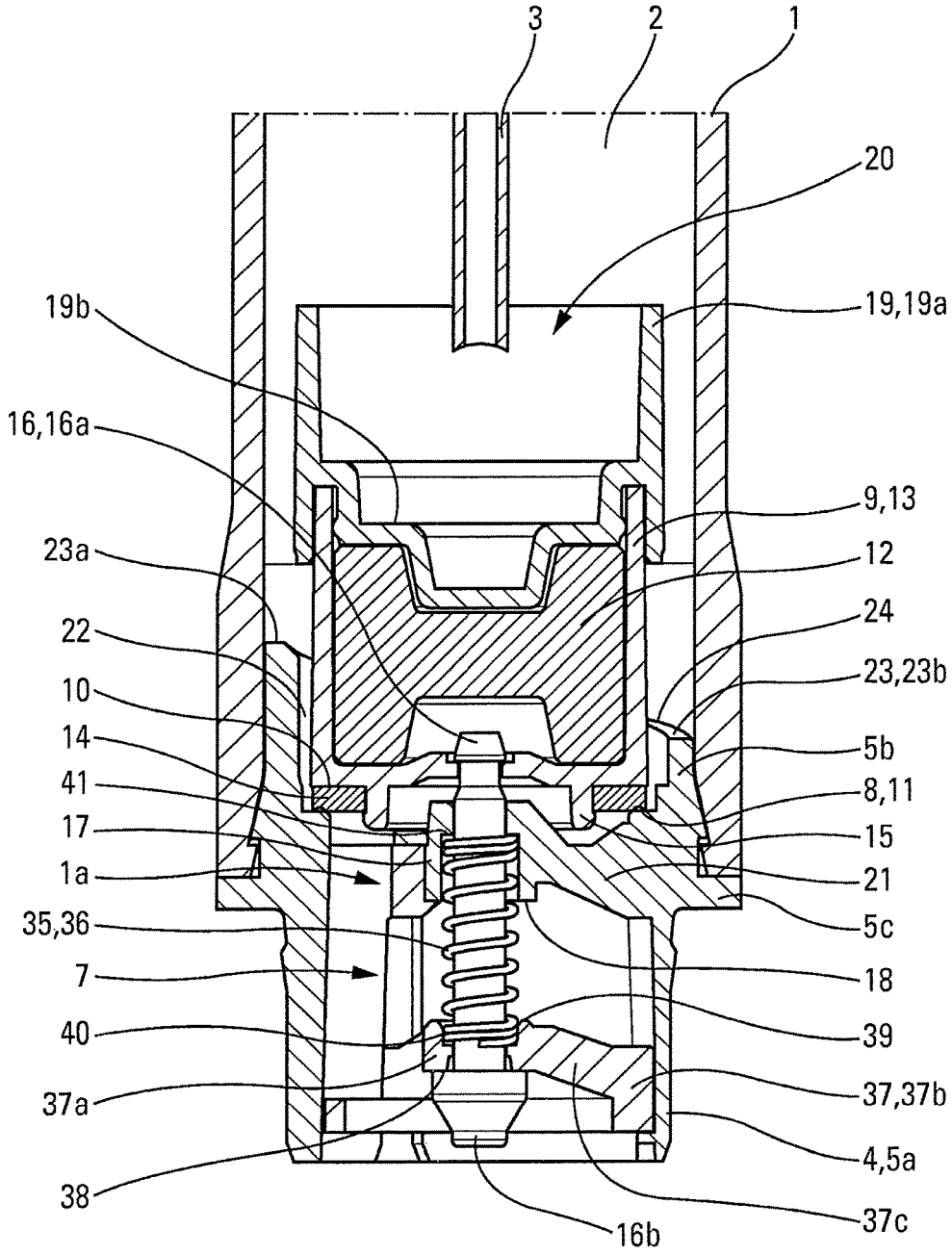
FIG. 1*a* is a partial longitudinal section and FIG. 1*b* is a partial perspective cut-away of a refillable bottle according to an embodiment of the invention.
Figure 1B:
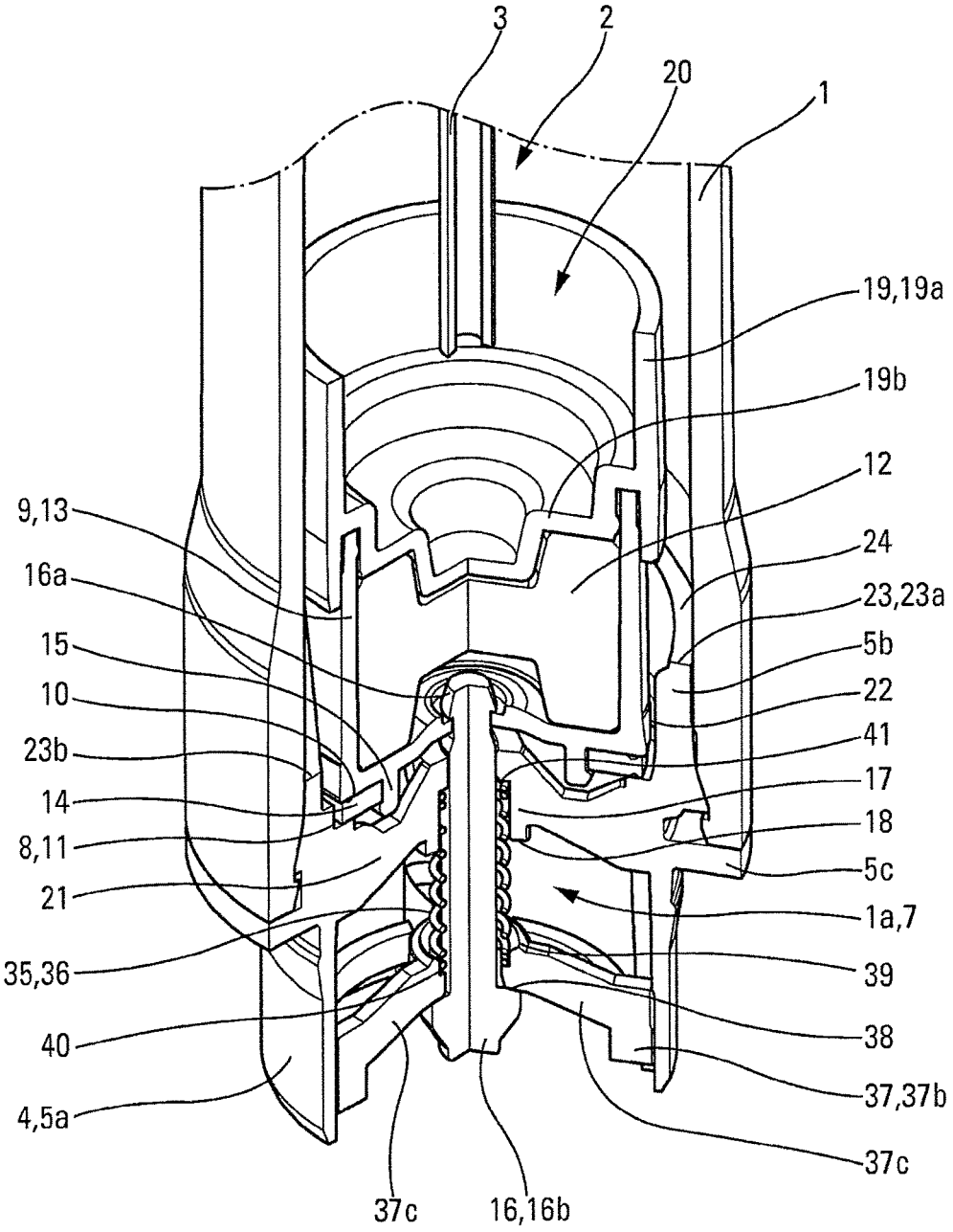
Figure 2A:
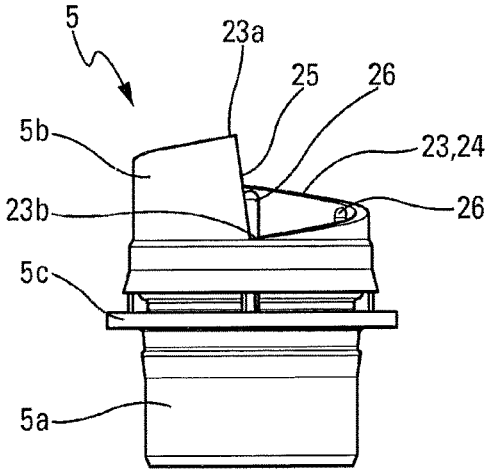
FIG. 2*a* is a front view and FIG. 2*b* is a perspective view showing the socket of the bottle in FIGS. 1*a* and 1*b;*
Figure 2B:
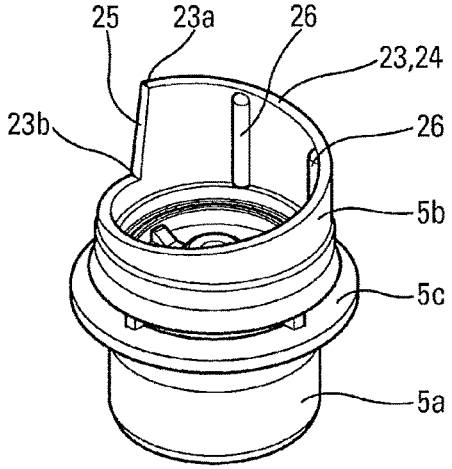
Figure 5A:
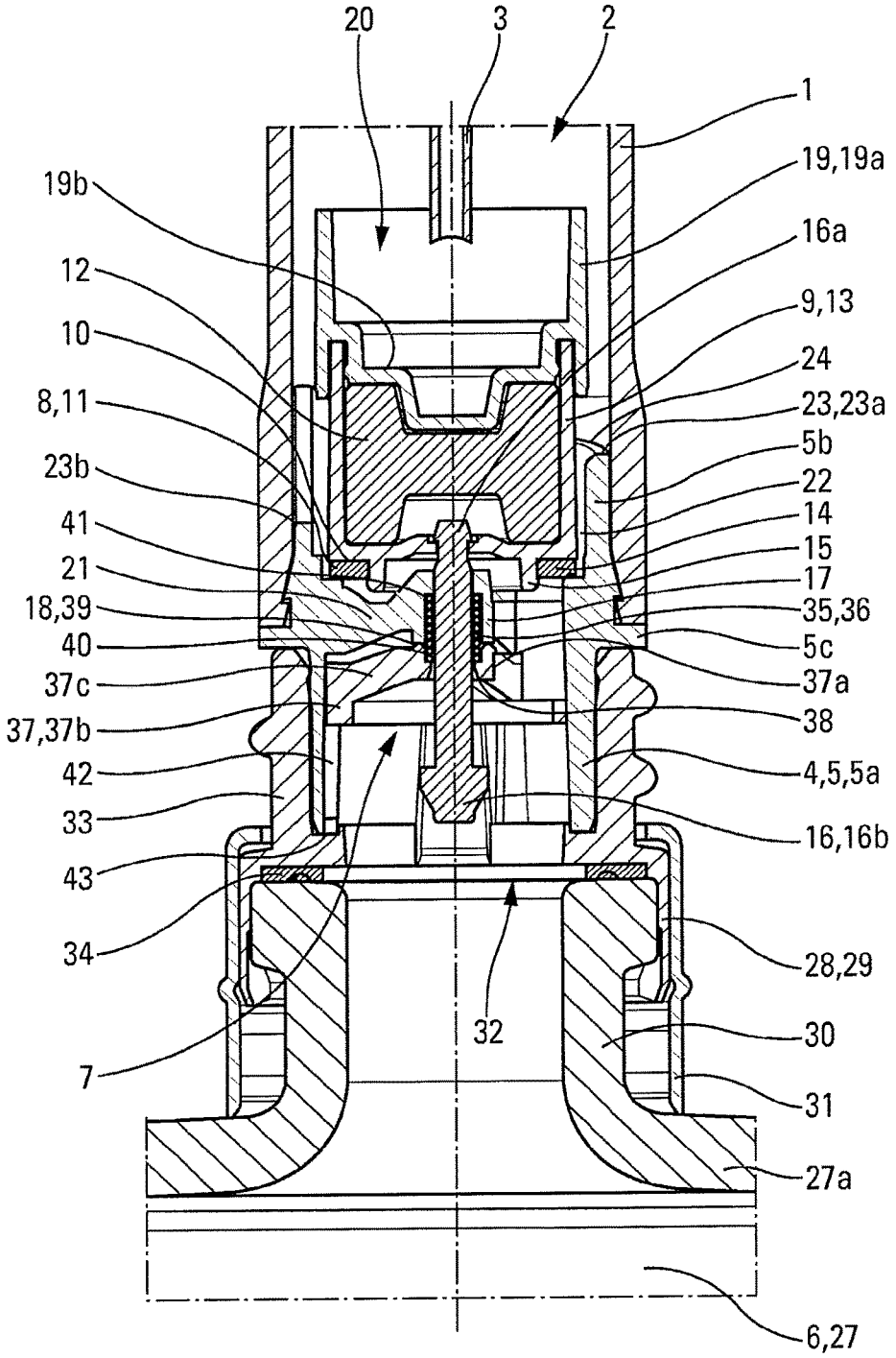
FIG. 5*a* is a partial longitudinal section through the connection of the refillable bottle in FIGS. 1*a* and 1*b* to the source in FIGS. 4*a* and 4*b* in the upright position and having a sealed closure and FIG. 5*b* is a partial longitudinal section through the connection of the refillable bottle in FIGS. 1*a* and 1 *b* to the source in FIGS. 4*a* and 4*b* in the upside-down position and having the passage opening for the purposes of filling.

In the description, the terms relating to positioning in space are taken with reference to the upright position of the refillable bottle as shown in particular in FIGS. 1*a*, 1*b* and 5*a*.

With reference to the drawings, a refillable bottle is described in the following which is intended to contain a fluid product in order to dispense said product. In particular examples, the product may be liquid, in particular a cosmetic treatment product, a make-up or perfume product, or a pharmaceutical product.

The refillable bottle comprises a body 1 in which a container 2 for packaging the product is formed. According to a particular application, the container 2 may have a capacity of between 1 and 10 ml to allow product samples to be dispensed.

In the embodiments shown, the body 1 is rigid, in particular having a rigidity which is sufficient for the volume of the container 2 to remain substantially constant even if the internal pressure varies. The body 1 may be formed in one piece, for example by injection blow moulding or extrusion blow moulding, or in a plurality of parts which are injected and then assembled, for example by ultrasound welding, by laser or by rotating friction and made of rigid plastics material, metal, for example aluminium, or glass.

The bottle comprises a device (not shown) for dispensing the packaged product which is mounted in a sealed manner in the body 1. In particular, the dispensing device may comprise a pump which is manually operated by means of a push-button, said pump being supplied with the product by means of a dip tube 3 which is arranged in the container 2.

However, the invention is not limited to a means of dispensing the product. In particular, other types of means for removing the product which is in the container 2 are conceivable. The dispensing device may also comprise means for applying the product, for example in the form of a ball.

The bottle is equipped with a valve 4 for filling the container 2 which is arranged to allow a product source 6 to be brought into communication with said container in order to fill said container. With reference to the drawings, the body 1 has a lower opening 1*a* which is equipped with the filling valve 4, and an upper opening in which the dispensing device is mounted, for example by means of a collar.

The lower opening 1*a* is formed in the base of the body 1 and the filling valve 4 has a socket 5 having a lower cylindrical coupling 5*a* which extends axially in a peripheral manner under said opening. Therefore, a communication conduit 7 is formed between the product source and the container 2, an upstream portion of said conduit extending in the lower cylindrical coupling 5*a*. In the drawings, the socket 5 is connected under the body 1, but it may also be formed in one piece with said body.

Figure 5B:
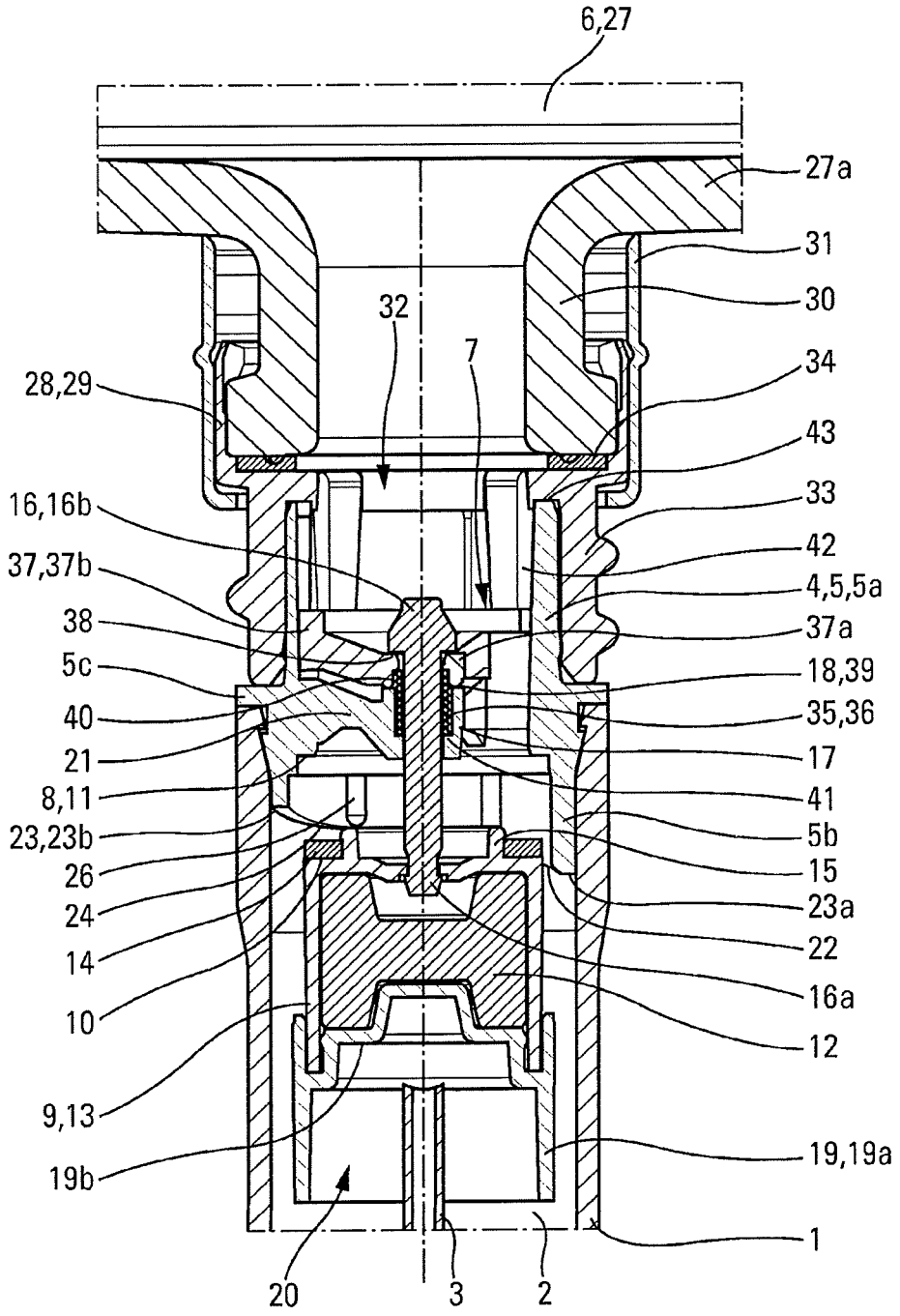

The communication conduit 7 has a seat 8 which is equipped with a flap valve 9 which is movable relative to said seat between a sealed closed position and an open position of said conduit when the bottle is in an upside-down position (FIG. 5*b*). In particular, the seat 8 is formed on an upper end of the lower cylindrical coupling 5*a*, the flap valve 9 being movable in axial translation between the closed and open positions thereof.

Advantageously, the flap valve 9 is arranged so as to be movable between the closed and open positions thereof under the effect of gravity, which is caused by positioning the refillable bottle in an upright position (FIG. 5*a*) and in an upside-down position (FIG. 5*b*) respectively. Therefore, the filling is carried out by simple gravitational flow through the conduit 7 between the product source 6 and the container 2 to be filled, it being possible to carry out the filling using a simple gesture for mounting the refillable bottle in the upright position on the product source 6, followed by turning the refillable bottle and product source 6 assembly upside down.

In a variant, the flap valve 9 may be arranged so as to be moved into the open position under the effect of an additional action by the user, for example by actuating the movement of the flap valve 9 in order to allow the product to flow under the effect of gravity when the bottle is in the upside-down position.

In the embodiment shown, the upright position corresponds to the normal use position of the refillable bottle in which the dispensing device is arranged towards the top. In a variant, the refillable bottle, when in the upright position, can be oriented differently, provided that the flap valve 9 is in the closed position under the effect of gravity at this point.

The refillable bottle, when in the upright position, may be mounted on and connected to the product source 6 without causing any product to be transferred, in particular owing to the absence of pressurisation of said product. The upside-down position then corresponds to a rotation of the refillable bottle and product source 6 assembly in order to arrange said source above the container 2 in order to cause it be filled by means of flow. In FIGS. 5*a* and 5*b*, the rotation is by 180°, but this may be a different angle, provided that it is sufficient for opening the flap valve 9 under the effect of gravity.

After filling, the refillable bottle and product source 6 assembly is returned to the initial position before said bottle is disconnected in order for it to be used subsequently. In particular, turning said assembly back over causes the flap valve 9 to be closed under the effect of gravity.

With reference to the drawings, the flap valve 9 comprises an annular bearing surface 10 which, in the closed position, comes into sealed abutment with a complementary bearing surface 11 of the seat 8 (FIGS. 1*a*, 1*b* and 5*a*), said bearing surface, in the open position, being arranged at a distance from said complementary bearing surface (FIG. 5*b*).

Moreover, the flap valve 9 is equipped with a ballast 12 of which the weight is sufficient to move said flap valve between the open and closed positions thereof. In particular, the ballast 12 brings about a force for pressing the annular bearing surface 10 against the complementary bearing surface 11 in a sealed manner and ensures that said bearing surfaces come apart when the assembly is turned back over.

The flap valve 9 comprises a peripheral cage 13, under which the annular bearing surface 10 is formed, an attached ballast 12, which is for example metal-based, being fixed in said cage. In a variant, the ballast 12 may be integrated with the flap valve 9, in particular by producing said flap valve on the basis of a high-density material, for example a polymer charged with metal particles or directly made of a metal material.

Moreover, the interface between the annular bearing surface 10 and the complementary bearing surface 11 is equipped with a seal 14 to ensure the sealing of the flap valve 9 in the closed position. With reference to the drawings, the flap valve 9 comprises a lower skirt 15 which extends axially from the annular bearing surface 10, and on the outer periphery of which the seal 14 is mounted so as to be interposed between the bearing surfaces 10, 11.

The flap valve 9 comprises a lower rod 16 which extends under the cage 13. In the embodiment shown, the upper end 16*a* of the rod 16 is snapped into a lower opening in the cage 13, but said rod may be formed in one piece with said cage.

The rod 16 is slidingly mounted in a tube 17 which is rigidly connected to the lower cylindrical coupling 5*a*, said rod and said tube being arranged to define the travel limit of the flap valve 9 in the open position. In order to do this, the rod 16 is equipped with an end piece 16*b* which cooperates with a lower edge 18 of the tube 17 to form a travel-limit downstop. In the embodiment shown, the end piece 16*b* is integrated with the rod 16. In a variant, the end piece 16*b* may be attached to the rod 16.

Moreover, the cage 13 is equipped with a cover 19 which makes it possible to prevent the ballast 12 from coming into contact with the product packaged in the container 2. Furthermore, the cover 19 forms a chamber 20 which is rigidly connected to the flap valve 9 by being arranged in the container 2, said chamber being arranged so as to be, in the upright position (FIGS. 1*a*, 1*b* and 5*a*), in communication with said container and to be, in the upside-down position (FIG. 5*b*), isolated from said container so that it is not filled with the product from the source 6.

Therefore, as the container 2 empties, an air space is formed which, when said container is turned upside down, is kept in the chamber 20 so as to be released into said container when it is returned to the upright position, and this ensures that there is an air space in said container after it is filled. In particular, the air space allows the product to expand when the temperature increases without exceeding the pressure which is admissible in the container 2.

The cover 19 has an axial peripheral wall 19*a* which extends over a lower radial wall 19*b*, the chamber 20 being formed within said walls so as to form a retention space of which the top part is open. In particular, the walls 19*a*, 19*b* are arranged such that the retention space, when in the upside-down position, is not in flow communication with the conduit 7.

The tube 17 is mounted in the lower cylindrical coupling 5*a* by means of at least one rib 21. In particular, three ribs 21 may be provided to form three openings in the communication conduit.

The socket 5 further comprises an upper cylindrical coupling 5*b* in which the flap valve 9 is movably mounted, forming, inside said upper cylindrical coupling, a downstream portion of the conduit 7 which discharges into the container 2 by means of a passage 22. With reference to the drawings, the upper cylindrical coupling 5*b* extends axially from the upper end of the lower cylindrical coupling 5*a*, where the seat 8 is formed, the passage 22 being formed at the interface between the peripheral cage 13 of the flap valve 9 and the inner wall of said upper cylindrical coupling 5*b*, and therefore downstream of the interface between the flap valve 9 and the seat 8.

In the embodiment shown, the upper cylindrical coupling 5*b* is formed in one piece with the lower cylindrical coupling 5*a*, the socket 5 being mounted in the lower opening 1*a* such that the lower cylindrical coupling 5*a* extends axially under said opening, the upper cylindrical coupling 5*b* extending axially in said body from said opening. In particular, the upper cylindrical coupling 5*b* has an outer wall which is arranged so as to be in clamping contact against the inner wall of the body 1, said outer wall further comprising a groove, into which the periphery of the lower opening 1*a* is snapped.

In a variant, the upper cylindrical coupling 5*b* and the lower cylindrical coupling 5*a* may be produced in two different parts, the socket 5 being formed in particular by assembling said parts before they are mounted in the lower opening 1*a*.

The upper cylindrical coupling 5*b* has a geometry which is cylindrical in revolution and in which a notch 23 is formed which is arranged so that the passage 22 is asymmetrical. In particular, the notch 23 forms upper 23*a* and lower 23*b* edges in the upper cylindrical coupling 5*b* which extend from the seat 8 over a maximum and minimum axial distance respectively.

Therefore, when the flap valve 9 is in the open position (FIG. 5*b*), the notch 23 makes it possible to open the passage 22 over a cross section having maximum dimensions in the region of the lower edge 23*b*, and this makes it possible to terminate the phenomenon of capillary action in this region at the interface between the flap valve 9 and the upper cylindrical coupling 5*b*, and therefore to make it possible to start the flow of product when filling the container 2.

Moreover, the presence of the upper edge 23*a* makes it possible to correctly ensure that the flap valve 9 is guided between the closed and open positions thereof, in particular by limiting the radial deflections of said flap valve when the bottle is rotated into either the upright or upside-down position, such deflections possibly proving to have an adverse effect on both the opening of the flap valve 9, and therefore on the filling of the container 2, and on the closure thereof.

In the embodiment shown, the notch 23 is formed by a circular spiral ramp 24 which extends between the upper 23*a* and lower 23*b* edges of the upper cylindrical coupling 5*b*, a side 25 axially connecting said edges.

Therefore, along the notch 23, the axial dimensions of the upper cylindrical coupling 5*b* vary in a progressive manner between the maximum dimensions of the upper edge 23*a* and the minimum dimensions of the lower edge 23*b*, and this makes it possible both to limit the capillary action at the interface between the flap valve 9 and the upper cylindrical coupling 5*b* and to ensure that said flap valve is axially guided over greater dimensions.

According to a particularly advantageous embodiment, the spiral ramp 24 extends at an angle over a path of between 350° and 370°. In particular, good results have been obtained by extending the ramp 24 over an angular path which is different from 360°, which allows the side 25 to be axially inclined.

Moreover, the inner wall of the upper cylindrical coupling 5*b* is equipped with protrusions 26 for guiding the movement of the flap valve 9 inside said cylindrical coupling, said protrusions being distributed angularly over the entirety of said inner wall and each having axial dimensions which are substantially equal to the local axial dimensions in the region of the angular position of said protrusions on said inner wall.

The product source 6 comprises a product container 27, in particular formed inside a bottle 27*a* having a capacity which is greater than that of the refillable bottle. According to another embodiment, the source container is formed inside a flexible pocket which can be filled with product without air or gas for the proper preservation of said product.

The source container 27 is equipped with a mount 28 which is arranged to allow the filling valve 4 to be connected to said source container in a sealed manner while bringing the conduit 7 into communication with said container. In order to do this, the filling valve 4 is equipped with a device for connecting the bottle to the product source 6 in a sealed manner, the mount 28 being equipped with a connection device which is complementary to that of the filling valve 4.

In the drawings, the mount 28 comprises a flange 29 for mounting on the neck 30 of the source bottle 27*a*, said flange being fixed to said neck by means of a collar 31. The flange 29 has an upper opening 32 on top of which a cylindrical coupling 33 is mounted which extends axially in a peripheral manner. Moreover, an annular seal 34 is interposed between the cylindrical coupling 33 and the neck 30.

Advantageously, the mount 28 does not have means for pressurising the filling product. Therefore, the bottle 27*a* cannot depart from its role of being the source, since it is without propellant gas or internal pressure. In particular, the cylindrical coupling 33 may be provided with a cap for closing the opening 32 between two filling processes.

The lower cylindrical coupling 5*a* of the filling valve 4 is arranged such that it can be connected to the source 6 in a sealed manner in order to carry out the filling by supplying the upstream part of the conduit 7 with product from said source.

In order to do this, the lower cylindrical coupling 5*a* is arranged to be able to slide axially relative to the mount 28. In particular, the cylindrical couplings 5*a*, 33 are annular, the outer diameter of the lower cylindrical coupling 5*a* being slightly less than the lower diameter of the cylindrical coupling 33 in order to allow the refillable bottle to be axially mounted on the product source 6 without play.

Furthermore, the lower cylindrical coupling 5*a* is slightly frustoconical and may have an inner chamfer in order to ensure that said lower cylindrical coupling is radially clamped in the cylindrical coupling 33 in a sealed manner during the axial sliding. Moreover, the socket 5 comprises an annular crown 5*c* with which the upper end of the cylindrical coupling 33 comes into axial abutment when it finishes sliding.

In order to ensure the sealing of the valve 4, the flap valve 9 is equipped with a device 35 for resiliently stressing the seal in the closed position, said device being arranged such that it can be uncoupled from the flap valve 9 in order to release the subsequent movement of said flap valve between the closed and open positions thereof.

In particular, the stressing device 35 makes it possible to ensure static sealing of the valve 4 between two processes for filling the bottle, said static sealing being terminated by uncoupling without any action on the flap valve 9, in particular without causing it to move.

Advantageously, the stressing device 35 is arranged so as to be uncoupled from the flap valve 9 by connecting the refillable bottle to the product source 6 in a sealed manner. Therefore, in order to be able to fill the bottle, the user only has to connect the valve 4 to the product source 6, without any additional action for uncoupling the stressing device 35, and this is a gesture which is particularly simple and intuitive.

With reference to the drawings, the stressing device 35 comprises a spring means 36 which exerts a force for pressing the flap valve 9 against the seat 8 in the closed position, and a back-up ring 37 by means of which said spring means is coupled to the flap valve 9. In particular, the back-up ring 37 is movable relative to the flap valve 9 from an active position in which the flap valve 9 is stressed by the spring means 36 in the closed position, into an inactive position in which the movement of the flap valve 9 is released from the action of said spring means.

In the embodiment shown, the spring means 36 is formed by a spiral spring which is mounted around the rod 16 of the flap valve 9 by being interposed under stress between the tube 17 of the lower cylindrical coupling 5*a* and the back-up ring 37.

The back-up ring 37 comprises a lower wall 38 which comes into abutment with the end piece 16*b* of the rod 16 when said ring is in the active position, and an upper wall 39 which comes into abutment with the lower edge 18 of the tube when said ring is moved towards the inactive position.

Therefore, insofar as the end piece 16*b* and the lower edge 18 together define the travel-limit stop for the flap valve 9 in the open position, the ring 37 is moved between the active and inactive positions thereof over a travel path which is equivalent to the travel path of the flap valve 9 between the closed and open positions thereof.

In order to allow it to move, the ring 37 has an inner crown 37*a* which is slidingly mounted around the rod 16. In particular, the inner crown 37*a* has an indentation 40 which is formed on the upper wall 39, in which the lower end of the spring means 36 is arranged so as to be supported.

Moreover, the upper end 36 of the spring means is arranged so as to be supported against an upper edge 41 which is formed inside the tube 17, the dimensions of said tube and the indentation 40 being arranged so that the lower edge 18 of said tube comes into abutment with the upper wall 39 by surrounding said indentation when the ring 37 is moved towards the inactive position. Therefore, in the inactive position, the spring means 36 is stressed by being enclosed in a closed housing, which makes it possible to isolate the product which passes through the conduit 7 when filling the bottle.

Figure 3:
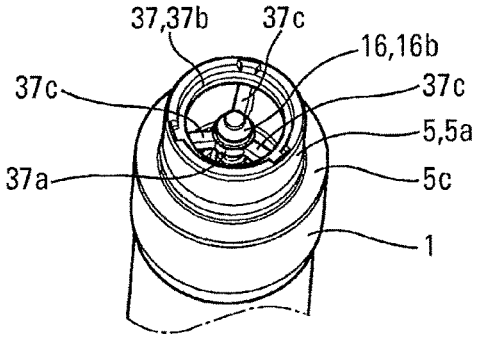
FIG. 3 is a partial perspective bottom view of the bottle in FIGS. 1*a* and 1*b*, showing the filling valve.
Figure 4A:
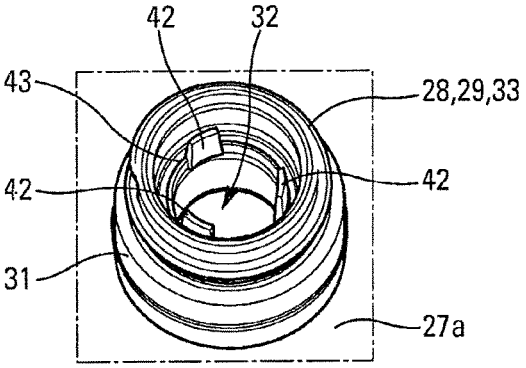
FIG. 4*a* is a partial perspective plan view and FIG. 4*b* is a partial perspective cut-away of the mount of a product source forming an assembly together with the bottle in FIGS. 1*a* and 1*b;*
Figure 4B:
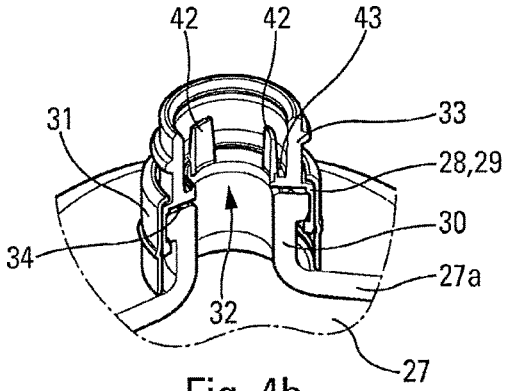

The back-up ring 37 further comprises an outer crown 37*b* which is slidingly mounted in the lower cylindrical coupling 5*a*, the inner crown 37*a* being mounted in said outer crown by means of at least one rib 37*c*. With reference to FIGS. 1*b* and 3, three ribs 37*c* are provided for this purpose in order to form three openings in the communication conduit.

Moreover, the cylindrical coupling 33 of the product source 6 has fingers 42 which are arranged to bear against the outer crown 37*b* in order to axially move the ring 37 into the inactive position when connecting the bottle to the product source 6 in a sealed manner.

In the embodiment shown, the cylindrical coupling 33 comprises an annular rim 43 which extends radially from the inner wall thereof, three fingers 42 being distributed angularly over the free end of said annular rim.

Furthermore, the dimensions of the lower cylindrical coupling 5*a* and of the fingers 42 are designed to allow said lower cylindrical coupling to come into axial abutment with the rim 43 and to be arranged so as to be in clamping contact between said fingers and the inner wall of the cylindrical coupling 33 during the sealing connection, in order to improve the sealing of said connection.

The invention claimed is:

1. Refillable bottle for dispensing a fluid product, comprising a body in which a container which is intended for packaging said product is formed, said bottle comprising a device for dispensing said packaged product which is mounted on said body in a sealed manner, said bottle being equipped with a valve for filling the container which is arranged to allow a product source to be brought into communication with said container in order to fill said container, said valve comprising a conduit for communication between said source and said container, said conduit having a seat which is equipped with a flap valve which is movable relative to said seat between a sealed closed position and an open position of said conduit when the bottle is in an upside-down position, wherein the flap valve is equipped with a device for resiliently stressing the seal in the closed position, said device being arranged such that it can be uncoupled from the flap valve in order to release the subsequent movement of said flap valve between the closed and open positions thereof.

2. Refillable bottle according to claim 1, wherein the stressing device is arranged so as to be uncoupled from the flap valve by said bottle being connected to the product source in a sealed manner.

3. Refillable bottle according to claim 1, wherein the stressing device comprises a spring means which exerts a force for pressing the flap valve against the seat, said spring means being coupled to the flap valve by means of a back-up ring which is movable relative to said flap valve into an inactive position in which the movement of the flap valve is released from the action of said spring means.

4. Refillable bottle according to claim 3, wherein the flap valve comprises a downstop which defines the travel limit of the flap valve in the open position, the back-up ring being movable from an active position on the downstop towards an inactive position at a distance from said downstop.

5. Refillable bottle according to claim 4, wherein the conduit is equipped with a tube in which a lower rod of the flap valve is slidingly mounted between the open and closed positions thereof, said rod having the downstop and the back-up ring being slidingly mounted on said rod between said downstop and said tube, the spring means being interposed under stress between said tube and said back-up ring.

6. Refillable bottle according to claim 3, wherein the back-up ring comprises an outer crown which is slidingly mounted in the conduit.

7. Refillable bottle according to claim 1, wherein the flap valve is arranged so as to be movable between the closed and open positions thereof under the effect of gravity, which is caused by positioning the bottle in an upright position and in an upside-down position respectively.

8. Refillable bottle according to claim 1, wherein the flap valve comprises a peripheral cage, under which an annular bearing surface is formed which, in the closed position, comes into sealed abutment with a complementary bearing surface of the seat, said bearing surface, in the open position, being arranged at a distance from said complementary bearing surface.

9. Refillable bottle according to claim 8, wherein the interface between the annular bearing surface and the complementary bearing surface is equipped with a seal.

10. Refillable bottle according to claim 1, wherein the valve has a lower cylindrical coupling in which an upstream part of the conduit is formed, said cylindrical coupling being arranged such that it can be connected to the source in a sealed manner in order to carry out the filling by supplying said upstream part of the conduit with product from the source.

11. Refillable bottle according to claim 6, wherein the valve has a lower cylindrical coupling in which an upstream part of the conduit is formed, said cylindrical coupling being arranged such that it can be connected to the source in a sealed manner in order to carry out the filling by supplying said upstream part of the conduit with product from the source;

wherein the outer crown is slidingly mounted in the lower cylindrical coupling.

12. Refillable bottle according to claim 7, wherein the flap valve is equipped with a ballast of which the weight is sufficient to move said flap valve between the open and closed positions thereof.

13. Refillable bottle according to claim 1, wherein the valve has an upper cylindrical coupling in which the flap valve is movably mounted, forming, inside said upper cylindrical coupling, a downstream portion of the conduit which discharges into the container by means of a passage, said upper cylindrical coupling having a geometry which is cylindrical in revolution and in which a notch is formed which is arranged so that the passage is asymmetrical.

14. Assembly comprising a refillable bottle according to claim 1 and a product source which is intended to fill said refillable bottle, said source comprising a product container which is equipped with a mount which is arranged to allow the filling valve to be connected to the source container in a sealed manner while bringing the conduit into communication with said container.

15. Assembly according to claim 14, wherein the valve has a lower cylindrical coupling in which an upstream part of the conduit is formed, said cylindrical coupling being arranged such that it can be connected to the source in a sealed manner in order to carry out the filling by supplying said upstream part of the conduit with product from the source;

wherein the lower cylindrical coupling is arranged to be able to slide axially relative to a cylindrical coupling of the mount in order to allow the refillable bottle to be mounted and fixed in the position in which it is connected to the source container.

16. Assembly according to claim 14, wherein the stressing device comprises a spring means which exerts a force for pressing the flap valve against the seat, said spring means being coupled to the flap valve by means of a back-up ring which is movable relative to said flap valve into an inactive position in which the movement of the flap valve is released from the action of said spring means;

wherein the back-up ring comprises an outer crown which is slidingly mounted in the conduit;

wherein the valve has a lower cylindrical coupling in which an upstream part of the conduit is formed, said cylindrical coupling being arranged such that it can be connected to the source in a sealed manner in order to carry out the filling by supplying said upstream part of the conduit with product from the source;

wherein the outer crown is slidingly mounted in the lower cylindrical coupling;

wherein the lower cylindrical coupling is arranged to be able to slide axially relative to a cylindrical coupling of the mount in order to allow the refillable bottle to be mounted and fixed in the position in which it is connected to the source container;

wherein the cylindrical coupling has fingers which are arranged to bear against the crown in order to axially move the ring into the inactive position during the sealed connection.

* * * * *